United States Patent [19]

Lorenzen et al.

[11] 4,373,772

[45] Feb. 15, 1983

[54] BAYONET-TYPE CIRCUIT BREAKER HAVING A MULTIPLE FINGER INTEGRATED CONTACT BAND

[75] Inventors: John H. Lorenzen, Pewaukee; John V. Majewski, Hales Corners, both of Wis.

[73] Assignee: RTE Corporation, Waukesha, Wis.

[21] Appl. No.: 248,564

[22] Filed: Mar. 27, 1981

[51] Int. Cl.[3] ..... H01R 13/68

[52] U.S. Cl. ..... 339/130 R; 337/252; 339/147 R; 339/201; 339/258 A

[58] Field of Search ..... 337/251, 252, 253, 254; 339/88 R, 126 R, 127 R, 127 C, 129, 130, 147 R, 200 R, 201, 252 R, 256 R, 256 RT, 258 R, 258 A, 258 P

[56] References Cited

U.S. PATENT DOCUMENTS 2,918,557 12/1959 Link ..... 337/205

FOREIGN PATENT DOCUMENTS 1089031 9/1960 Fed. Rep. of Germany ... 339/258 A 1128500 4/1962 Fed. Rep. of Germany ... 339/256 R 893055 4/1962 United Kingdom ..... 339/257 R

*Primary Examiner*—John McQuade

*Attorney, Agent, or Firm*—Raymond E. Fritz

[57] ABSTRACT

A bayonet-type circuit breaker or under oil fuse device for completing the circuit from a high voltage bushing to an under oil transformer, the bayonet type device including a bayonet assembly having a circuit element at the end and a support assembly mounted on the transformer tank and having a tubular portion extending into the oil in the tank, the tubular portion including a pair of skirts at each contact location on the tubular portion and an elongate band of conductive spring metal material bent into a square configuration and having a number of spring fingers integrally formed along the axis of the band with a contact button on the free end of each finger, the band being mounted on the tubular portion of the support assembly between the skirts in a position to engage the circuit element, the inherent bias of the fingers holding the buttons in engagement with the contacts at each end of the circuit element.

19 Claims, 10 Drawing Figures

BAYONET-TYPE CIRCUIT BREAKER HAVING A MULTIPLE FINGER INTEGRATED CONTACT BAND

BACKGROUND OF THE INVENTION

Bayonet-type circuit breakers or fuses of the type contemplated herein are generally shown in U.S. Pat. No. 2,918,557 issued on Dec. 22, 1959 to E. A. Link and entitled "Circuit Breaker." In this type of a device, a bayonet assembly having a circuit bridging element is inserted into a support assembly mounted on a tank for an electrical apparatus to complete the primary circuit to a transformer immersed in insulating oil provided in the tank. Electrical communication between the circuit breaker or fuse and the circuit is provided by multiple piece contact assemblies mounted on the support assembly. Each contact assembly includes a number of contact members and a bias spring which encircles the support assembly and is threaded through the contact members. The contact members must carry current sufficient to handle transformer loading and resist the effects of arcing during switching. These functions must be maintained for the life of the device which will often exceed thirty years.

SUMMARY OF THE INVENTION

The bayonet-type circuit breaker or fuse according to the present invention is provided with an improved electrical contact band formed from a single piece of conductive metallic material and assembled as a single unit on the support assembly. The band is provided with a number of integral fingers having contact buttons on the free end and utilizes the inherent bias of the conductive copper material to hold the conductive buttons in contact with the electrical contacts of the circuit breaker or fuse. The contact band is bent in the form of a square so that it will contact the support assembly at only four points thereby increasing the exposure of the band to the cooling action of the fluid dielectric material provided within the transformer tank. A simple interlocking arrangement is provided at the ends of the band for securing the band on the support assembly. In a modified embodiment of the invention, increased load carrying capability is provided by reorienting the direction of the longitudinal axis of the contact fingers. This embodiment also improves the hinging movement of the band for mounting on the support assembly through a reduced cross sectional area provided at the center of the band. The support assembly includes locating skirts for each contact band to increase the electrical creepage distance between the contact bands.

IN THE DRAWINGS

DESCRIPTION OF THE INVENTION

Figure 1:
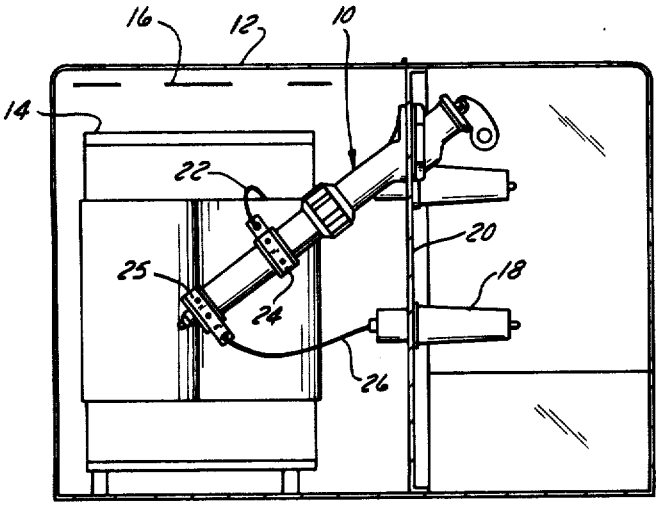
FIG. 1 is a view partly in section showing a bayonet-type circuit breaker mounted on a ground level transformer tank to complete the primary circuit for the transformer.

Referring to the drawings and particularly FIG. 1, a bayonet-type circuit breaker or under oil fuse 10 is shown mounted on a tank 12 in which a electrical apparatus 14 in the form of a transformer is immersed in a dielectric fluid or oil 16. A high voltage bushing 18 is shown mounted on the wall 20 of the transformer tank and is connected by means of a line 26 to the first of a pair of electrical contact bands 25 provided on the bayonet circuit breaker or fuse 10. The second contact band 24 is connected to the electrical apparatus 14 by means of a line 22. The bayonet-type circuit breaker or fuse 10, as seen in the drawing, is connected in series between the bushing 18 and the electrical apparatus 14 to open and close the primary line to the transformer 14.

Figure 3A:
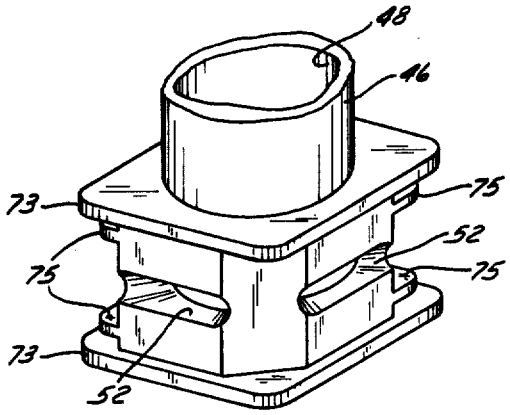
FIG. 3A is a perspective view of a portion of the housing showing the contact band mounting site.
Figure 2:
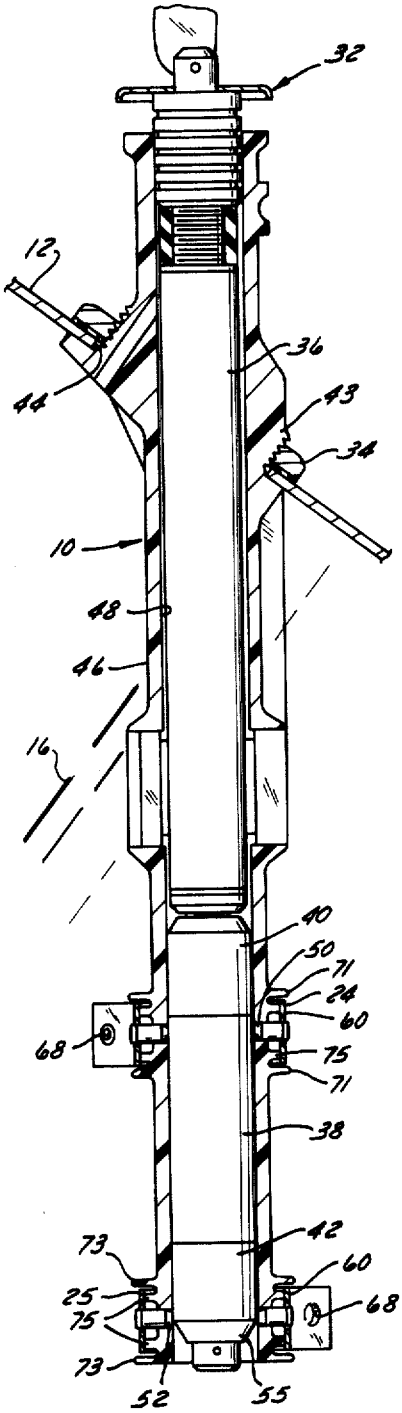
FIG. 2 is a view partly in section of a bayonet-type circuit breaker showing the bayonet assembly partially inserted into the support assembly.
Figure 3:
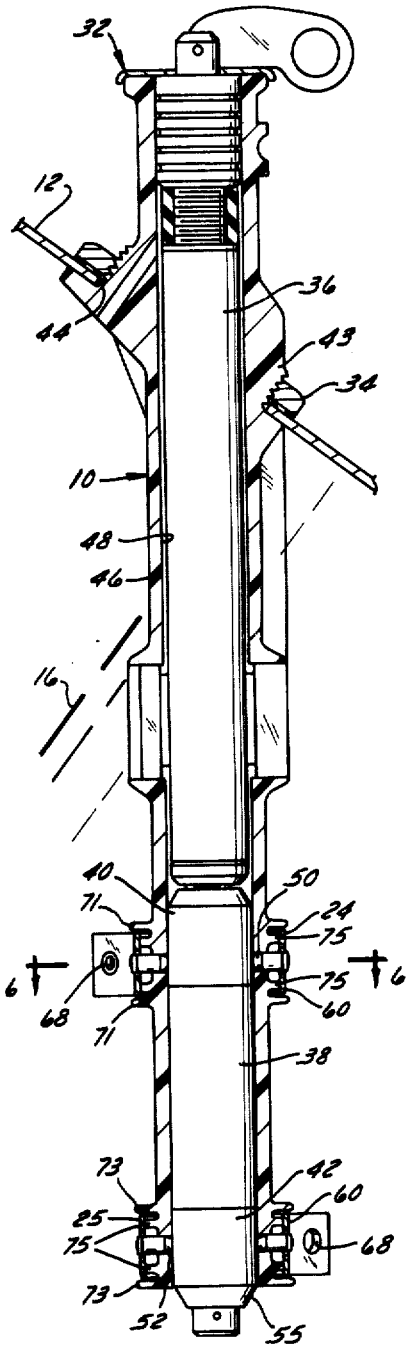
FIG. 3 is a view similar to FIG. 2 showing the bayonet assembly seated within the support assembly with the contact bands according to the invention in electrical communication with the circuit breaker or fuse contacts.

More particularly, and referring to FIGS. 2, 3, and 3A, the bayonet-type circuit breaker or fuse 10 generally includes a bayonet assembly 32 and a support assembly 34. The bayonet assembly 32 includes an insulating rod 36 and a circuit bridging element 38 in the form of a circuit breaker or fuse secured to the inner end of the rod 36. The circuit bridging element 38 includes a pair of electrical contacts 40 and 42 which are used to close the circuit across the contact bands 24, 25.

In accordance with the invention, the support assembly 34 includes an upper tubular portion 43 which can be mounted in an opening 44 provided in the tank 12 and a lower tubular portion 46 having a bore 48. Two sets of tapered contact receptacles or openings 50 and 52 are provided at the lower end of the tubular extension 46 to provide communication to the bore 48.

The bayonet assembly 32 is slideable within the bore 48 of the support assembly to open or close the primary circuit. Electrical communication between the lines 22 and 26 and the contacts 40 and 42 is provided by means of the electrically conductive contact bands 24 and 25.

Figure 5:
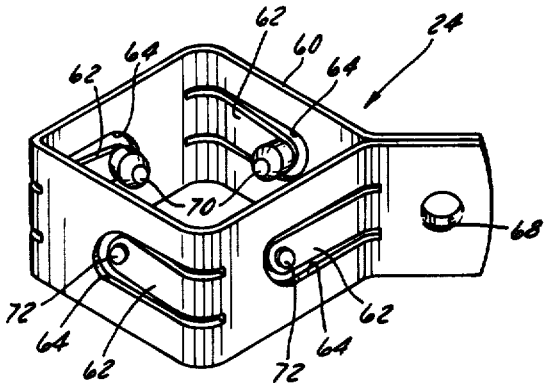
FIG. 5 is a perspective view of the electrical contact band bent to a square configuration.
Figure 6:
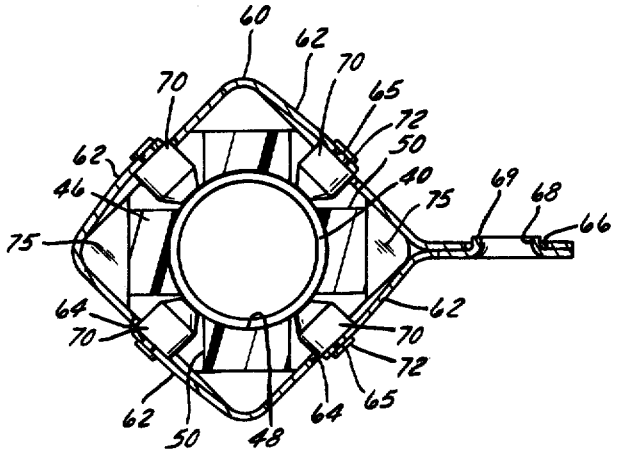
FIG. 6 is a view taken on line 6—6 of FIG. 3 showing one of the contact bands mounted on the support assembly.
Figure 4:
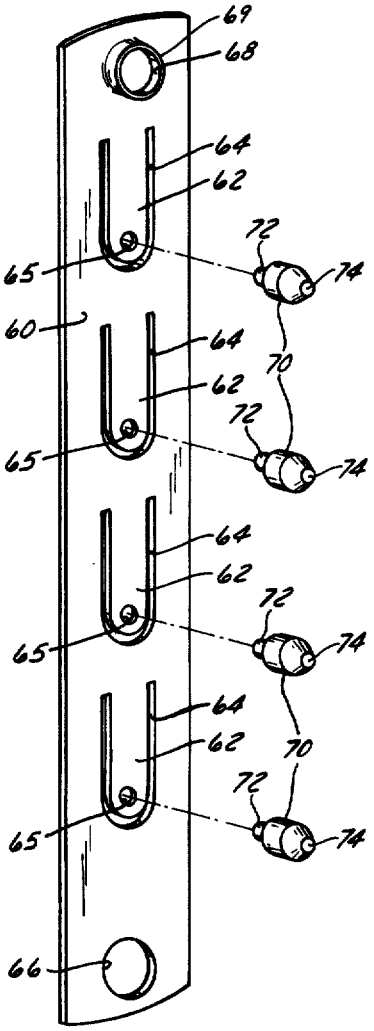
FIG. 4 is a exploded perspective view of the electrical contact band.

In this regard and referring to FIGS. 5 and 6, each of the contact bands 24 and 25 are formed from an elongate band 60 of conductive metallic spring material such as copper having a number of equally spaced cantilever-type contact fingers 62 cut or stamped along the longitudinal axis of the band 60. As seen in FIG. 5, each of the fingers 62 is defined by a U-cut 64 with all of the fingers being disposed in the plane of the band and extending in the same direction with respect to the longitudinal axis of the band 60. A hole 65 is provided at the free end of each of the fingers 62. Locating holes 66 and 68 are provided at each end of the band with a flange or ridge 69 provided around the inner edge of the hole 68. The band is bent to form a square as seen in FIG. 6 with one of the fingers 62 located on each side of the square. It should be noted that the free ends of the fingers are located approximately in the middle of each side of the square.

Electrical contact between the fingers 62 and the contacts 40 or 42 on the bayonet assembly is provided by means of electrically conductive buttons 70 secured to the fingers 62. Each button 70 includes a projection 72 at one end and a tapered contact 74 at the other end. The projection 72 is inserted through the hole 65 provided at the end of the finger 62 and swedged to rivet the contact 70 to the finger 62.

Means are provided on the tubular portions 46 of the support assembly for maintaining the contact bands in position on the contact receptacles 50, 52. Such means as seen in FIGS. 2, 3, and 3A, is in the form of two pair of skirts 71 and 73 provided on each side of the contact receptacles 50 and 52 respectively. The skirts 71 and 73 also provide means for increasing the electrical clearance between the contact bands 24 and 25. The skirt 73 at the lower end of the tubular portion also acts as a gas flow baffle, preventing gases at the lower end of the housing from traveling up the outside surface of the support assembly 34.

Means have been provided to increase the torque strength of the contact assembly 60. Such means is in the form of triangular protrusions 75 provided at the contact band termination 68 and on the opposite side of the tubular portion 46.

The contact bands 24 and 25 are mounted on the tubular portion 46 of the support assembly 34 as seen in FIGS. 2 and 3 by placing the band 24 on the protrusions 75 between the skirts 71 with the buttons 70 in alignment with contact receptacles 50 and the band 25 on the protrusions 75 between the skirts 73 with the buttons 70 in alignment with contact receptacles 52. The holes 66 and 68 in each band are aligned with each other with the flange 69 projecting through hole 66. The ends of each of the bands are secured together by deforming the flange 69 by any appropriate means to engage the outer portions of the band 60 outward. The tapered contacts 74 at the inner ends of the buttons 70 project inwardly through tapered receptacles 50 or 52 into the bore 48 of the tubular portion 46.

As seen in FIGS. 2 and 3, the contacts 40 and 42 have an outer diameter substantially equal to or slightly smaller than the inner diameter of the tubular portion 46. On insertion of the bayonet assembly into the tubular portion 46, the tapered end 55 of the bayonet assembly will engage the tapered contacts 74 camming the buttons 70 and fingers 62 outwardly. The inherent bias of the material of the conductive band 60 will bias the buttons 70 into direct contact with contacts 40 or 42. A positive electrical contact is thereby achieved between the band and the contact 40 or 42.

It should be noted in FIG. 2, that electrical contact is made between the contact 42 and the contact band 25 prior to engagement of contact band 24 with contact 40. The circuit is completed, as seen in FIG. 3, when the bayonet assembly is fully seated in the support assembly.

Figure 8:
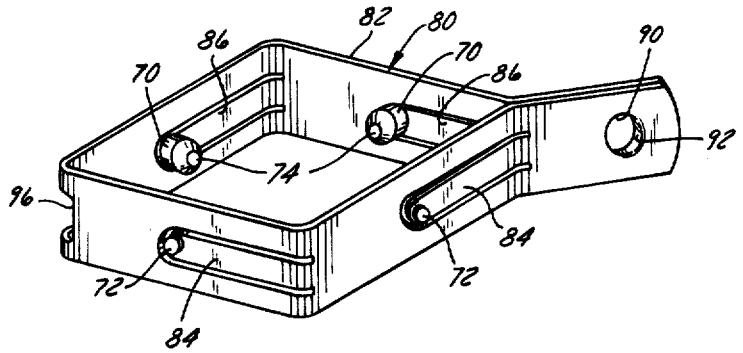
FIG. 8 is a perspective view showing the modified band bent to a square configuration.
Figure 9:
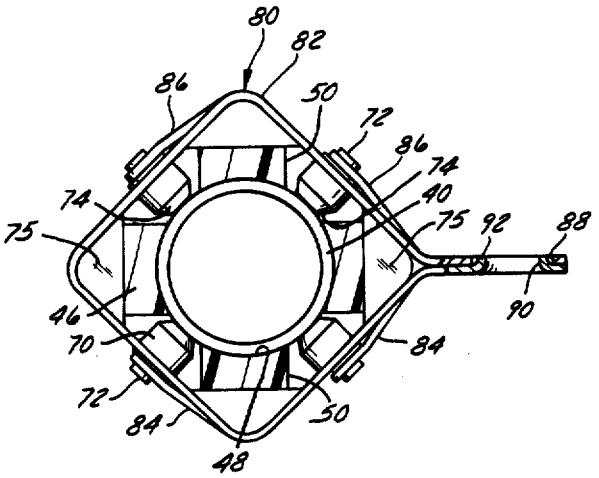
FIG. 9 is a cross section view of the support assembly showing the modified band mounted on the support assembly.
Figure 7:
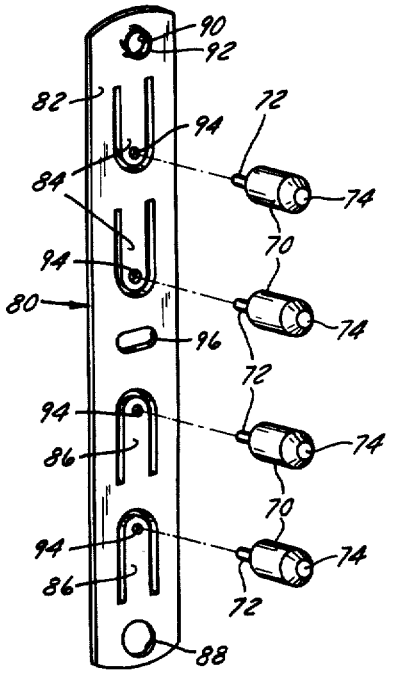
FIG. 7 is a exploded perspective view of an alternative embodiment of the contact band according to the present invention.

Referring to FIGS. 7, 8 and 9, a modified contact band 80 is shown which has increased load carrying capability as well as improved hinging ability. The contact band 80 is formed from a conductive metallic spring material in the form of an elongate band 82 having two pairs of contact fingers 84 and 86. Mounting holes 88 and 90 are provided at each end of the band with a flange 92 around hole 90 as described above. Holes 94 are provided at the end of each contact finger. Contact buttons 70 are mounted on each contact finger as described above.

Means are provided for increasing the current carrying capabilities of the band. This is achieved by reversing the hinged end of one pair of contact fingers 86 so that the free end of each pair of fingers is pointed at the center of the band and the hinged end is located closer to the mounting hole 88. The current carrying path from each finger to the ends of the band will then be shorter. With this arrangement, the center of the band does not have to carry as much of the load thereby allowing for a reduction in the cross sectional area of the band. A hole 96 is provided in the center of the band making it easier to hinge or bend the band when mounting the band is expanded or opened for mounting on the support assembly thereby eliminating any distortion in the sides of the band.

We claim:

1. In a bayonet-type load break circuit breaker or oil fuse, including a support assembly adapted to be mounted in an opening in the tank for an oil-filled electrical apparatus and a bayonet assembly adapted to be removably insertable into said support assembly, the bayonet assembly including an insulating rod having a conductive bridging circuit member at the inner end of the insulating rod, the conductive member having a pair of contacts, the support assembly including a tubular portion submersible into the oil in the tank and having a number of contact openings to provide access to the contacts on the conductive member, the improvement comprising square contact bands, each formed of an elongate band of conductive metallic material, a number of fingers formed along each band and normally lying in each plane of the band, each of said fingers positioned on one side of said square, each of said fingers including a contact button at the free end, said bands being adapted to be mounted on the tubular portion of the support assembly with the buttons extending through the openings toward the axis of the tubular portion whereby said bayonet assembly will force the buttons outwardly against the bias of the fingers on insertion into the support assembly.

2. The apparatus according to claim 1 wherein each of said bands includes two pairs of contact fingers, each pair extending in the opposite direction from the other pair.

3. The apparatus according to claim 2 wherein each of said bands includes means for reducing the cross sectional area of the band at the center.

4. The apparatus according to claim 1, 2 or 3 wherein said support assembly includes means for maintaining the axial position of the band on the support assembly.

5. The apparatus according to claim 1, 2, 3 or 4 wherein said tubular portion has a generally octagonal outer configuration at the position where each contact band is mounted on said tubular portion.

6. An electrically conductive contact band for maintaining electrical communications with an electrical contact in a bayonet-type circuit breaker, the circuit breaker including a bayonet assembly having a bridging electrical member at the end and a support assembly adapted to be mounted on the wall of a transformer casing, the bayonet assembly being slideably receivable in said support assembly, said contact band comprising an elongate band of conductive material, a plurality of fingers formed along the axis of said band, a conductive button mounted on the end of each of said fingers, said band being bent into a square configuration with one finger on each side of the square and said button projecting inwardly to engage said bridging electrical member.

7. The band according to claim 6 wherein said fingers are hinged to the band at one end with the free end of each finger extending in the same direction.

8. The band according to claim 6 wherein said fingers are hinged to the band at one end with half of the fingers extending in the opposite direction to the other half of the fingers.

9. The combination with an electrical apparatus immersed in an insulating fluid within a tank and having a high voltage bushing mounted on the tank, a tubular support member mounted on the tank, a bayonet type under oil circuit breaker including a bayonet assembly adapted to be inserted through the tubular member below the level of fluid in the tank, a number of contact openings in the wall of said tubular support member disposed below the level of the fluid in the tank, a square contact band of conductive material mounted on the support member to surround the contact openings, said band being adapted to be connected to the high voltage bushing and the electrical apparatus, said band including a contact finger on each side of said square in a position to project through said contact openings into the path of travel of the bayonet assembly whereby the inherent spring force of the fingers will hold the fingers in electrical engagement with the bayonet assembly.

10. The combination according to claim 9 wherein said band includes first and second pairs of contact fingers and a termination end, and wherein each of said first and second pairs of fingers are directed away from said termination end.

11. The combination according to claim 9 wherein said tubular support member includes axial positioning means for defining said axial position of the contact band on the support member.

12. The combination according to claim 11 wherein said axial positioning means comprises a pair of skirts for each contact band.

13. The combination according to claim 9, 10, 11 or 12 wherein said tubular support member has a generally octagonal outer configuration at the position where said contact band is mounted thereon and said openings are in circumferentially alternate sides of said octagonal portion.

14. In combination with an electrical apparatus immersed in a tank and a high voltage bushing, a bayonet type circuit breaker assembly for connecting the bushing to the electrical apparatus, the circuit breaker assembly including a bayonet type under oil circuit breaker and a tubular support member mounted on the tank and having two sets of contact openings provided in a spaced relation in the support member and a square band for each set of openings, each band including a number of contact fingers corresponding to the number of openings in the corresponding set of openings, each finger positioned on one side of said square, each finger including a contact button projecting through the opening to provide electrical communication with the circuit breaker.

15. The combination according to claim 14 wherein said support member includes means for defining the axial limits of movement of the bands on said tubular support member.

16. The combination according to claim 15 wherein said axial limit means comprises a pair of skirts for each band.

17. The combination according to claim 15 or 16 including a pair of protrusions on opposite sides of said support member to support said band.

18. The combination according to claim 14, wherein each tubular support member at the position of said contact openings has a generally octagonal cross-section.

19. The combination according to claim 18 wherein said contact band has a termination end and said fingers each having fixed and free ends forming first and second pairs of contact fingers, each of said pairs having said fixed end of said fingers positioned toward said termination end whereby the free ends of each pair of fingers are directed away from said termination end.

* * * * *